United States Patent [19]

Olkkola

[11] 4,086,699

[45] May 2, 1978

[54] ROOF STRIPPING TOOL

[76] Inventor: E. Alfred Olkkola, 24 Wilson Rd., West Yarmouth, Mass. 02673

[21] Appl. No.: 737,493

[22] Filed: Nov. 1, 1976

Related U.S. Application Data

[63] Continuation-in-part of Ser. No. 593,796, Jul. 7, 1975, abandoned.

[51] Int. Cl.[2] ..... A47L 13/02

[52] U.S. Cl. ..... 30/172; 254/131.5; 294/54

[58] Field of Search ..... 30/172, 169, 171; 254/131.5, 131, 104; 299/36, 37; 15/236 R; 294/54

[56] References Cited

U.S. PATENT DOCUMENTS

| | | | |
|---|---|---|---|
| 1,260,276 | 3/1918 | Miller | 294/54 |
| 1,377,484 | 5/1921 | Huneryager | 30/172 |
| 2,769,236 | 11/1956 | Phillips | 30/169 |
| 3,074,694 | 1/1963 | Erickson | 30/172 X |
| 3,113,758 | 12/1963 | Knowles | 30/169 X |
| 3,818,593 | 6/1974 | Oliverius | 30/169 |
| 3,836,119 | 9/1974 | Saucier | 30/169 X |

FOREIGN PATENT DOCUMENTS

| | | | |
|---|---|---|---|
| 1,055,184 | 4/1952 | France | 294/49 |
| 206,933 | 10/1940 | Switzerland | 15/236 R |

*Primary Examiner*—Jimmy C. Peters
*Attorney, Agent, or Firm*—Robert R. Churchill

[57] ABSTRACT

The invention relates to a tool and in particular to a tool for removing roofing material including shingles from the roof of a building. The tool consists of a metal blade member having novel means enabling it to be readily inserted under shingles to thereby lift and remove the same from the base of the roof of a building and at the same time remove or shear the roofing nails, and a handle for guiding the blade member during the stripping operation.

9 Claims, 5 Drawing Figures

FIG. 1
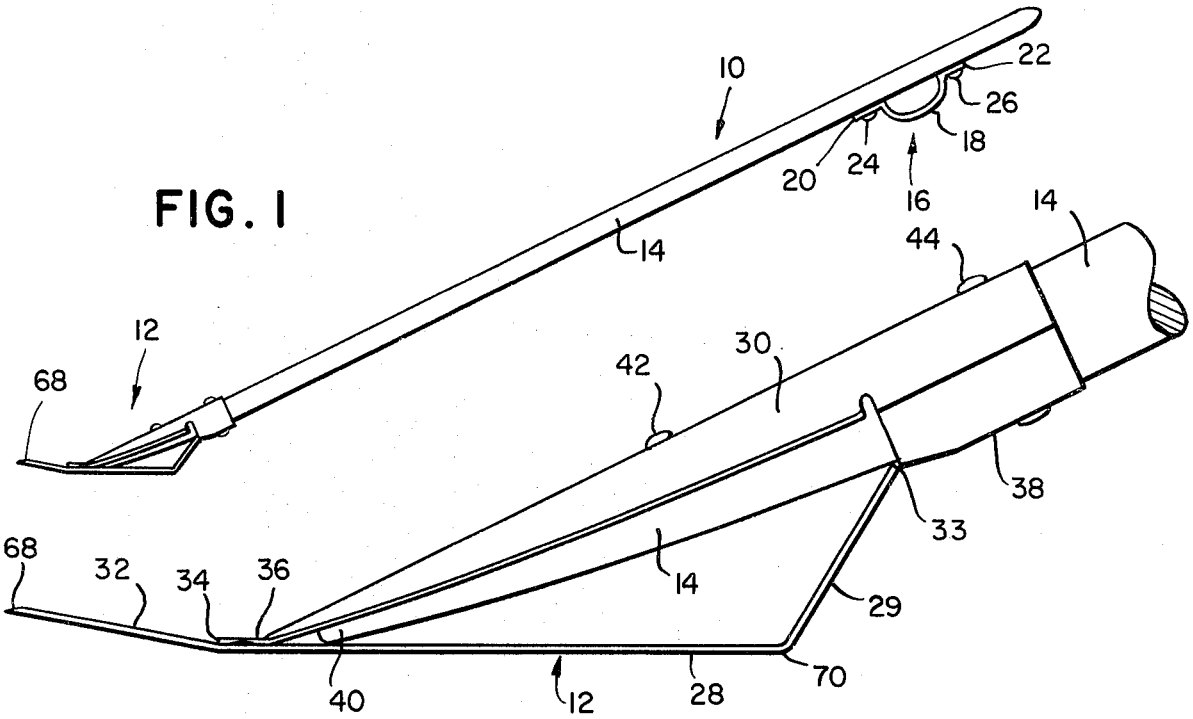
FIG. 2
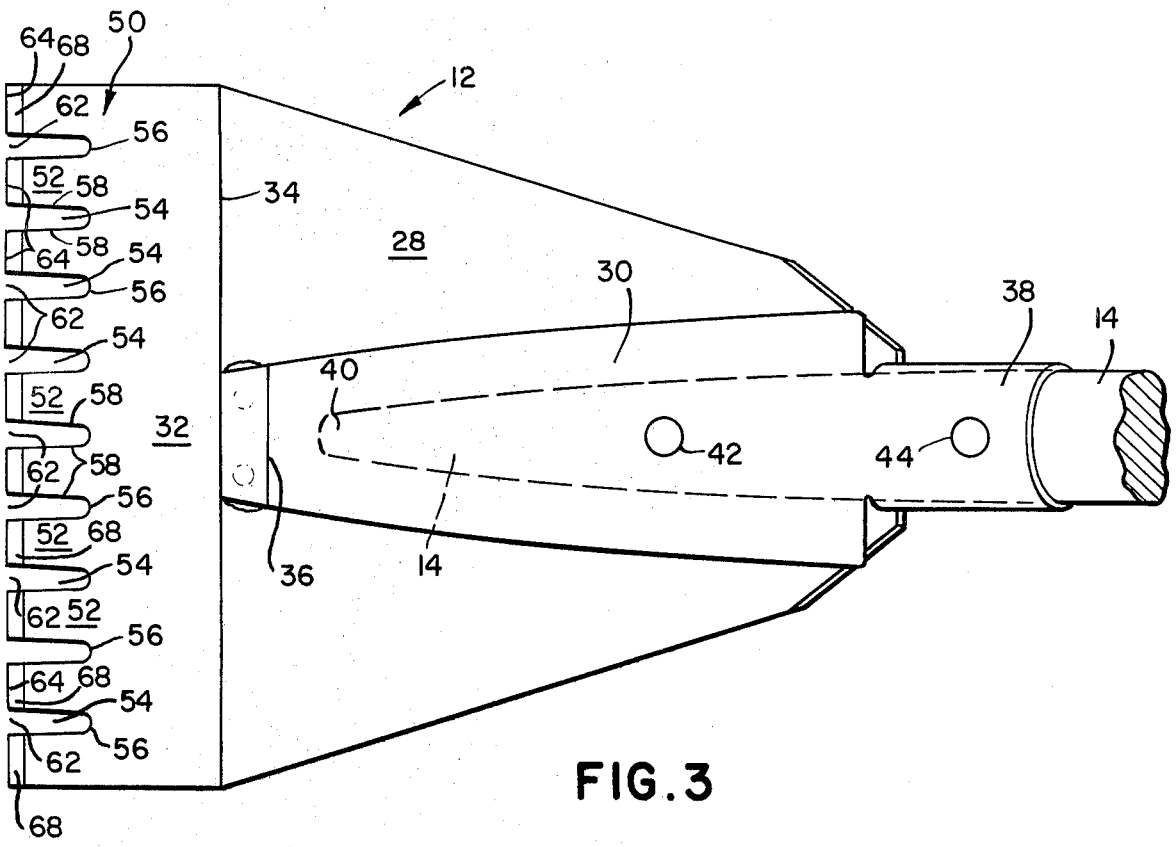
FIG. 3

ROOF STRIPPING TOOL

This application is a continuation-in-part of my copending application Ser. No. 593,796 filed July 7, 1975, now abandoned.

BACKGROUND OF THE INVENTION

The invention resides in the field of roofing tools and in tools for stripping the worn shingles whether wooden or asphalt from the roof prior to the installation of a new roof.

DESCRIPTION OF THE PRIOR ART

Prior to the present invention I am aware of a tool referred to as a slate bar which may be purchased on the open market, that is used in an endeavor to strip a roof of its worn-out roofing material preparatory to the application of a new roof. The most common tool used by builders or roofers is an ordinary square tipped garden spade. The roofing tools manufactured, of which I am aware, while operable to some extent, do not enable the stripping operation to be performed in as rapid and efficient manner as may be desired. The ordinary garden spade is probably the most commonly used. Other tools of which I am aware are often broken due to their structure, expensive and far from efficient in use.

In contrast to the prior art tools for use in the roofing and building trades the present invention contemplates a novel and improved tool of basically simple constructions which may be efficiently used to remove worn shingles and shingle nails from a roof in an efficient and rapid manner.

FIELD OF THE INVENTION

The present invention has for a principal object to provide a novel and improved roofing tool adapted to strip a roof of its covering in a rapid and efficient manner.

Another object of the invention is to provide a novel and improved roofing tool embodying structure which enables more than a single row of shingles to be removed in a single stroke of the tool.

A still further object of the invention is to provide a novel and improved manual roofing tool embodying novel structure which causes shingles or other roofing material to be lifted readily during use and at the same time nails sheared and/or removed.

Another object of the invention is to provide a novel and improved manually operated roofing tool hereby shingles may be readily stripped from a roof which embodies an improved structure permitting the tool to be inserted easily under the shingles, and embodies novel means for lifting, the worn shingles, shearing and removing roof nails, which is characterized as embodying substantial structural strength whereby the life of the tool is substantially increased.

Another object is to provide a novel and improved roofing tool for stripping a roof of worn shingles characterized by novel structure for supporting and securing the handle to the blade portion thereof, whereby damage of the tool during use is reduced to a minimum.

In the drawings illustrating the preferred embodiment of the invention;

FIG. 1 is a side elevation of the present tool;

FIG. 2 is an enlarged detail view inside elevation of the blade of the tool with the handle broken away;

FIG. 3 is a plan view of the blade member of the tool;

SUMMARY OF THE INVENTION

Figure 4:
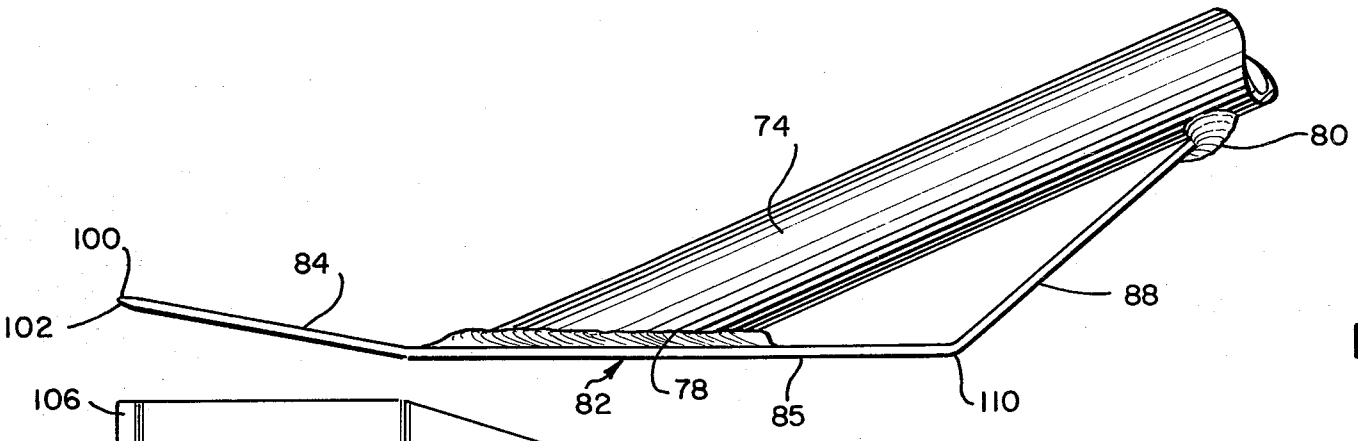
FIG. 4 is a side elevation of a modified form of the present invention with the handle broken away.

Referring now to the drawings illustrating the preferred embodiment of the invention, and to FIG. 1 in particular, illustrates the present roofing tool having a blade portion 12 and an elongated handle 14. As shown the handle is provided with a hand guard 16 comprising a generally semi-circular portion 18 and laterally extended flanges 20, 22. The guard 16 is secured to the handle by means of screws 24, 26. In use the fingers of knuckles of the user are protected against injury by the guard which surrounds the knuckles of the user.

The blade portion 12 or working part of the tool as best shown in FIGS. 2 and 3 comprises a metal base plate 28 to which is welded an upwardly inclined flanged socket portion 30. The leading edge or forward portion 32 of the base plate 28 is bent upwardly at an angle of approximately 10° from the horizontal axis of the plate 28. As illustrated in FIG. 2, in particular, the rear portion 29 of the base plate 28 is bent upwardly approximately 70° relative to the base plate and welded to the flange portion 30, as at 33.

Also as best shown in FIGS. 2 and 3 the leading edge 36 of the inclined flanged socket portion 30 is welded to the base plate 28 along the bend line 34 of the leading edge portion 32 of the plate 28. In this manner the flanged portion 30 is finally and integrally secured to the base plate at an angle of approximately 26° relative to the horizontal axis of the base plate 28. The upper end of the socket portion 30 comprises a collar 38 through which the handle 14 is passed and the leading end 40 of the handle 14 is inserted fully into the position shown in FIGS. 2 and 3, with its leading end 40 wedged into position between the base plate 28 and underside of the flange portion 30 adjacent the leading edge of the flange as welded along the line 34 of the base plate 28.

The handle 14 is secured in position, as shown, by means of rivets 42, 44.

From the foregoing description it will be apparent that the handle 14 is supported in its operative position, at an angle of 26° relative to the horizontal plane of the base plate 28 by means of the collar 38, through which it is passedd and at its leading end 40 firmly wedged into and secured in position between the underside of the flange portion 30 and base plate 28. Thus the structure of the handle and blade portion of the tool provide substantial strength such that bending and displacement of these parts of the tool and breakage of the tool by downward pressure exerted during use is reduced to a minimum.

Referring now to the cutting edge of blade portion 12, 50 indicates a row of a plurality of individual spaced teeth 52. As shown, for purposes of illustration, but not by way of limitation, the present tool includes ten teeth one-half inch in width and spaced one quarter inch apart. The spaces 54 between the teeth 52 are slots defined by the margins or adjacent teeth and are generally U-shaped. The inner or closed ends 56 of the slots being rounded as shown with the marginal side edges 58 of the teeth as shown being tapered outwardly to thereby provide a relatively wide entrance portion 62 into which any nails not sheared by the teeth are received and caught at the narrow end thereof to be removed from the roof.

The leading edges 64 of the teeth 52 lie the same plane and are straight and parallel relative to the weld line 29, as best shown in FIG. 3. Each tooth is provided with a one-eighth inch bevel 68. This provides a cutting edge for shearing roofing nails during the operation of the tool in stripping the roofing or siding material from a building as well as facilitating the insertion of the tool under the shingles.

In operation the tool is grasped by the elongated handle with the user's fingers extended through the hand guard 16. The tool is then moved into position on the roof such that the beveled leading edge 68 is inserted under the row of shingles to be stripped from the roof and the blade portion 12 driven forward sheared off and others are directed into the slots or spaces 54 and caught at the narrow inner portion of the slots between the teeth. The handle is then pressed downwardly with the forward portion of the blade portion 12 pivoting upwardly on the heel 70 of the blade portion 12. Thus the shingles and nails are lifted and torn from the base of the roof.

It will be noted that the smooth line from the blade 12 upwardly to and as extended by handle 14 enables the lifted shingles to ride up smoothly and freely onto the handle and jamming of the tool substantially eliminated.

The upwardly bent portion 32 of the blade portion 12 enables the pivotal movement of the forward end of the blade to be increased by 10° thus providing additional lift which increases the efficiency of the tool in its stripping action.

Figure 5:
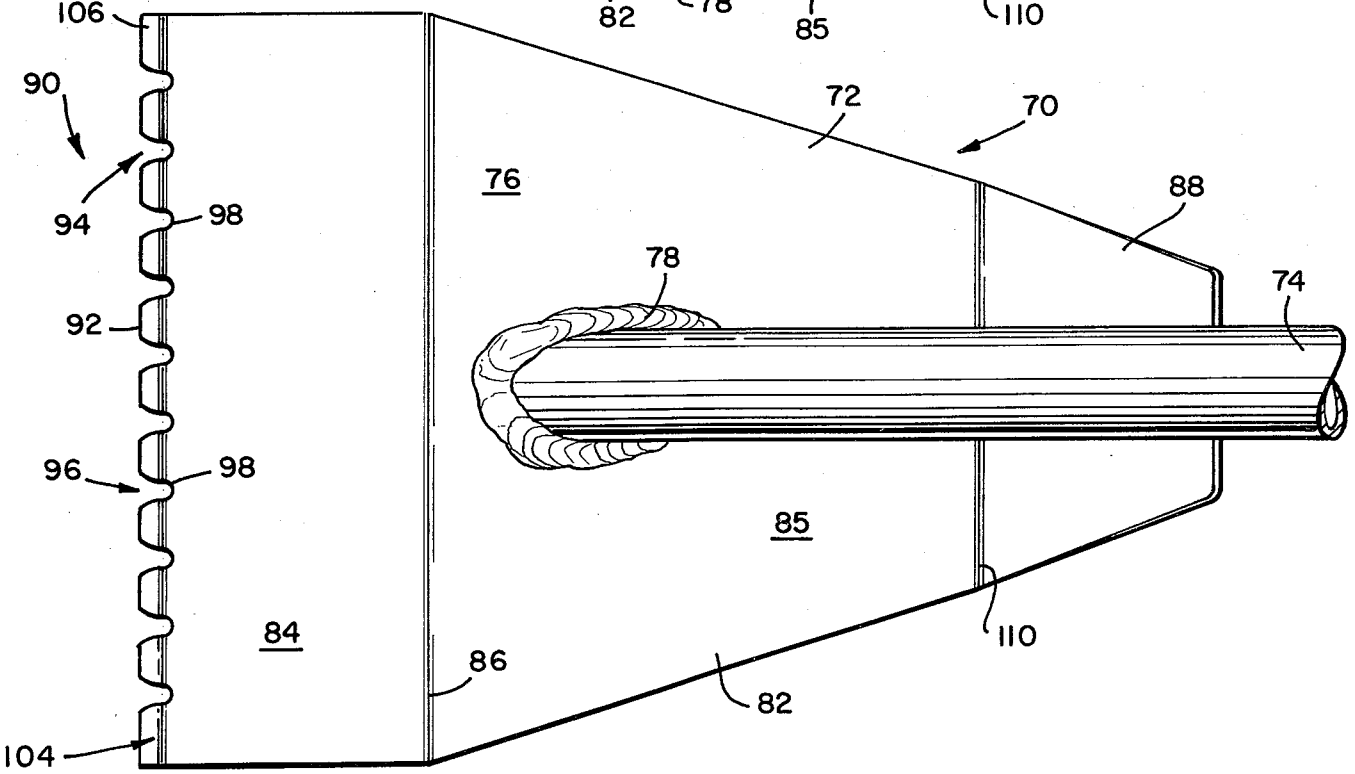
FIG. 5 is a plan view of the blade portion of the tool.

In a modified form of the present invention as best shown in FIGS. 4 and 5 the roofing tool 70 comprises a blade member 72 and a handle 74 for the blade member. As illustrated the handle 74 is fabricated of 0.0125 inch steel pipe cut to a preferable length, for example 5 feet, and is welded to the upper surface 76 of the blade member 72 as at 78, 80. The handle is also preferably provided with a handguard, not shown, similar to the handle guard 16 as heretofore described in connection with the preferred form of the invention. The metal pipe handle provides the increased strength necessary to long tool life.

As illustrated in FIG. 4 the blade member 72 comprises a flat base plate 82 having its forward portion 84 bent upwardly along a line 86 just forward of the handle weld 78. This elevated portion provides more lift to the tool in use in stripping a roof.

The blade member 72 as viewed in FIG. 5 is shaped to provide a substantially rectangular bent-up forward portion 84, a tapered central section 85 and a bent-up rearmost section 88 to which the handle is welded as at 80, FIG. 4. As shown the rearmost section 88 is bent upwardly relative to the base plate approximately 50°. The angle to which the section 88 is bent determines the angle the handle 74 assumes and thus may vary within reasonable limits.

Referring now to FIG. 5, in particular, the forward or leading edge of the forward portion 84 is provided with a plurality of teeth as indicated at 90. The teeth are cut or machined to provide a plurality of rather short tines 92 separated by slots 94 having a wide entrance portion 96 and rounded inner closed ends 98. The slots 94 are particularly constructed and arranged to permit roofing nails to be guided into them, caught and pulled from the roof and yet not become jammed in the slots impeding the stripping operation. The leading edges of the tines are straight, flat and blunt and each tine is beveled top 100 and bottom 102. The beveled portions 100, 102 assist in facilitating movement of the blade under the shingles.

It has been found that the outer or marginal tines on either side of the blade are often subjected to severe stress and shearing action when the tool is pushed on edge or twisted during use and therefore outer tines 104, 106 are substantially wider than the remaining tines 92.

From the foregoing description of the leading edge of the blade it will be apparent that the wide relatively short blunt tines 92 together with the wider stronger marginal tines 104, 106 substantially increase the durability and strength of the present roofing tool are thereby its life and efficiency.

One of the important structural features of the present roofing tool is in the provision of the shoulder 110 formed by of base plate 85 and bent up portion 88. This shoulder is important to the operation of the tool since it provides a surface on which the tool maybe rocked up and down by raising and lowering the handle. This movement causes relative movement of the blade and the roofing material and nails to be torn from the roof being stripped.

It will be understood that the blade member 72 must be fabricated of a strong, tough metal and to this end the present blade member is fabricated of 40 - 50 carbon steel which is heat treated to a spring steel temper. Thus damage or breakage of the blade member is substantially eliminated.

From the foregoing description of the present invention both in its preferred and modified forms it will be apparent that the present novel structure not only provides a roofing tool having great strength and durability but also provides for highly efficient operation wherein the tine for stripping a roof is substantially reduced.

With the present tool more than one row of shingles may be stripped from the roof at one time and further the structure and arrangement of the tines substantially increases the nail pulling and shearing efficiency of the tool.

It will be understood that while the present tool has been described as for use in stripping shingles, whether wood, asphalt, or other materials, it is within the contemplation of the invention that the tool be used for stripping siding from the buildings as well.

Having thus described the invention, what is claimed is:

1. A roofing tool for use in stripping shingles from the roof of a building comprising: a blade member and a handle for the blade member, wherein the forward portion of the blade member is turned upwardly relative to the body portion, the central portion of the body portion lying in a horizontal plane and the rear portion thereof turned upwardly forming a shoulder on which the tool is rocked to raise and lower the forward portion during use, the forward portion of the blade member being substantially rectangular and provided with a plurality of relatively short spaced teeth defining therebetween a plurality of slots, the leading edges of the teeth being flat and the entrance portions of the slots being relatively wide and tapered inwardly to rounded inner ends for catching and pulling nails during use of the tool.

2. A roofing tool as defined in claim 1, wherein the outer marginal teeth are wider than the inner teeth.

3. A roofing tool as defined in claim 1, wherein the leading edge of each of the teeth is beveled top and bottom.

4. A roofing tool for stripping the shingles from the roof of a building comprising a blade member, and a handle for the blade member, said blade having a flat horizontal body portion, (a) an upwardly bent forward portion having square tipped teeth and an upwardly bent rear flange portion forming a pivot point on which the tool is rocked during use to tear up the roofing material and pull nails from the roof.

5. A roofing tool for stripping a roof comprising, in combination, a blade member and a handle for the blade member, said blade member having an upturned leading edge, and elongated substantially horizontal body portion and an upwardly bent rear flange portion forming a pivot point for the blade member, an elongated flange secured to the blade member and having a socket at one end through which the leading end of the handle is extended, the leading edge of the blade member having a plurality of square tipped flat teeth, said teeth spaced apart and forming there between substantially U-shaped slots, the leading edges of the teeth beveled and forming a relatively sharp edge on each tooth whereby the tool may be driven under the shingles, the roofing nails sheared off and the shingles lifted and stripped upon downward pressure on the end of the handle.

6. A roofing tool as defined in claim 5, wherein the forward portion of the blade member is substantially rectangular and the body of the blade is tapered rearwardly from the rectangular portion.

7. A roofing tool as defined in claim 6, wherein the handle is provided with a finger guard.

8. A roofing tool as defined in claim 5, wherein the leading end of the handle extends through the socket and is seated between the juncture of the elongated flange and the body portion of the blade member, and means for securing the handle to the flange.

9. A roofing tool for stripping a roof comprising, a blade member and a handle for the blade member, said blade member having an up-turned leading edge, an elongated flat body portion and an upwardly bent rear flange portion forming a pivot point for the blade member, the leading edge of the blade member having a plurality of flat, short, square tipped teeth, said teeth being spaced apart and define there between slots for catching roofing nails during use of the tool and the leading edges of the teeth being flat (blunt) and beveled top and bottom.

* * * * *